US007438770B2

(12) United States Patent
Yuse et al.

(10) Patent No.: US 7,438,770 B2
(45) Date of Patent: Oct. 21, 2008

(54) HIGH STRENGTH SPRING STEEL HAVING EXCELLENT HYDROGEN EMBRITTLEMENT RESISTANCE

(75) Inventors: Fumio Yuse, Kobe (JP); Kenji Saito, Kobe (JP); Shushi Ikeda, Kobe (JP); Koichi Sugimoto, Nagano (JP)

(73) Assignees: Kobe Steel, Ltd., Kobe-shi (JP); Shinshu TLO Co., Ltd., Ueda-shi (JP)

( * ) Notice: Subject to any disclaimer, the term of this patent is extended or adjusted under 35 U.S.C. 154(b) by 80 days.

(21) Appl. No.: 11/340,547

(22) Filed: Jan. 27, 2006

(65) Prior Publication Data

US 2006/0169367 A1 Aug. 3, 2006

(30) Foreign Application Priority Data

Jan. 28, 2005 (JP) ..... 2005-021502
Sep. 6, 2005 (JP) ..... 2005-258347

(51) Int. Cl.
*C22C 38/02* (2006.01)
*C22C 38/04* (2006.01)
*C22C 38/06* (2006.01)

(52) U.S. Cl. ..... 148/320; 148/330; 148/333; 148/334; 148/335; 148/336; 148/908

(58) Field of Classification Search ..... 148/320, 148/330, 332–336, 908, 595, 598, 599
See application file for complete search history.

(56) References Cited

U.S. PATENT DOCUMENTS

| | | | |
|---|---|---|---|
| 2005/0150580 | A1 | 7/2005 | Akamizu et al. |
| 2006/0169367 | A1 | 8/2006 | Yuse et al. |

FOREIGN PATENT DOCUMENTS

| | | | |
|---|---|---|---|
| EP | 1553202 | * | 7/2005 |
| JP | 5-320826 | | 12/1993 |
| JP | 9-324219 | | 12/1997 |
| JP | 10-183302 | | 7/1998 |
| JP | 2001-288539 | | 10/2001 |
| JP | 2003-105485 | | 4/2003 |
| JP | 2003-193193 | | 7/2003 |
| JP | 2004-143482 | | 5/2004 |
| JP | 2004-190050 | | 7/2004 |
| JP | 2004-332099 | | 11/2004 |
| JP | 2004-332100 | | 11/2004 |
| JP | 2005-23404 | | 1/2005 |
| JP | 2005-220440 | | 8/2005 |

OTHER PUBLICATIONS

Computer-generated English translation of Japanese patent 2004332099, Usami Akira, Nov. 25, 2004.*
Computer-generated English translation of Japanese patent 2004190050, Sugimoto Koichi, Jul. 8, 2004.*
The English abstract of Japanese patent 406010109, Wakita, Masami, Jan. 18, 1994.*
The English abstract of Japanese patent 409324219, Shimotsusa, Masaki et al., Dec. 16, 1997.*
U.S. Appl. No. 11/340,472, filed Jan. 27, 2006, Yuse et al.
U.S. Appl. No. 11/340,547, filed Jan. 27, 2006, Yuse et al.
U.S. Appl. No. 11/317,174, filed Dec. 27, 2005, Yuse et al.
U.S. Appl. No. 11/317,181, filed Dec. 27, 2005, Yuse et al.
Tomohiko Hojo, et al. "Hydrogen Embrittlement of Ultra High Strength Low Alloy TRIP-Aided Steels"; Tetsu-To-Hagane; vol. 90; No. 3; Mar. 1, 2004; pp. 65-70.
U.S. Appl. No. 11/910,029, filed Sep. 28, 2007, Akamizu et al.
U.S. Appl. No. 11/910,013, filed Sep. 28, 2007, Kashima et al.
U.S. Appl. No. 11/874,516, filed Oct. 18, 2007, Ikeda et al.

* cited by examiner

*Primary Examiner*—Deborah Yee
(74) *Attorney, Agent, or Firm*—Oblon, Spivak, McClelland, Maier & Neustadt, P.C.

(57) ABSTRACT

The present invention provides a high strength steel used for spring steel that has excellent hydrogen embrittlement resistance.

The high strength steel which spring steel having excellent hydrogen embrittlement resistance comprises 0.20 to 0.60% of C, 1.0 to 3.0% of Si, 1.0 to 3.5% of Mn, higher than 0% and not higher than 1.5% of Al, 0.15% or less P, 0.02% or less S, and balance of iron and inevitable impurities and the structure includes:

1% or more residual austenite;
80% or more in total of bainitic ferrite and martensite; and
10% or less (may be 0%) in total content of ferrite and pearlite in the proportion of area to the entire structure, and also the mean axis ratio (major axis/minor axis) of the residual austenite grains is 5 or higher and the steel tensile strength is 1860 MPa or higher.

8 Claims, No Drawings

HIGH STRENGTH SPRING STEEL HAVING EXCELLENT HYDROGEN EMBRITTLEMENT RESISTANCE

BACKGROUND OF THE INVENTION

1. Field of the Invention

The present invention relates a high strength spring steel that has excellent hydrogen embrittlement resistance, particularly to a high strength spring steel wherein hydrogen embrittlement, season crack and delayed fracture, that cause troubles for spring steels having tensile strength of 1860 MPa or higher, are suppressed.

2. Description of the Related Art

Chemical compositions of spring steels, that are used to make high strength springs such as valve spring of automobile engine and suspension spring, are specified in JIS G 3565-3567 and JIS G 4801. The springs are manufactured by drawing a hot rolled steel of the specified composition until the wire diameter is reduced to a predetermined size, applying oil tempering treatment and processing the steel wire into a spring (cold formed coil spring), or by drawing a rolled steel, forming the steel wire into spring by heating, followed by quenching and tempering (hot formed coil spring).

As automobiles are increasingly designed to be lighter in weight, springs used in the automobiles are required to have higher strength and some springs have achieved tensile strength of 1800 MPa or higher. However, increasing strength of springs causes concern over the problem of so-called delayed fracture, in which the spring suddenly cracks after a long period of use.

To counter such a problem, for example, Japanese Unexamined Patent Publication (Kokai) No. 10-183302 describes a method of improving corrosion resistance by adding alloy elements such as Cr, V, Ni, Cu, B and/or Nb to the basic components and improving delayed destruction resistance by is making the crystal grains smaller. Japanese Patent Publication No. 3064672 describes a method of improving toughness and corrosion resistance of the steel that has been subjected to quenching and tempering by adding Ni, Cr, Cu, V to the basic components, thereby improving the fatigue setting resistance and the hydrogen embrittlement resistance.

Japanese Unexamined Patent Publication (Kokai) No. 2001-288539 describes a method of improving hydrogen embrittlement resistance by containing at least one of oxide, carbide and nitride that contain one or more kind selected from among V, Mo, Ti, Nb and Zr as a hydrogen trap site and composite precipitate of two or more kinds of these compounds. Specifically, hydrogen embrittlement resistance is improved by controlling the mean grain size of the precipitate within a range from 0.05 μm to 1.0 μm, and controlling the mean grain distance within a range from 3 to 30 times the mean grain size.

However, the alloy elements used in these technologies are expensive and it is difficult to provide a high strength spring steel that has high level of delayed destruction resistance at a low price. There is also such a problem that it is difficult to recycle a spring that contains much contents of the alloy elements described above.

Japanese Unexamined Patent Publication (Kokai) No. 2004-143482 describes that hydrogen embrittlement resistance has been improved by controlling the structure by a method that does not require the addition of the alloy elements described above. Specifically, hydrogen embrittlement resistance of high strength spring steel wire is improved by making a structure that is constituted mainly from martensite or bainite where prior austenite crystal grains are made smaller, and limiting the number of coarse undissolved carbide grains. However, there is a limitation to the improvement in the hydrogen storing capacity by controlling the form of precipitation, and it is difficult to achieve higher hydrogen embrittlement resistance by this method.

SUMMARY OF THE INVENTION

The present invention has been made in consideration of the problems described above, and has an object of providing a high strength spring steel that has high tensile strength of 1860 MPa or higher and has significantly improved hydrogen embrittlement resistance.

The high strength spring steel of the present invention consists of 0.20 to 0.60% of C (contents of components given in terms of percentage in this patent application all refer to percentage by weight), 1.0 to 3.0% of Si, 1.0 to 3.5% of Mn, higher than 0% and not higher than 1.5% of Al, 0.15% or less P, 0.02% or less S, and iron and inevitable impurities for the rest, and is characterized in that the structure consists of:

1% or more residual austenite;

80% or more in total of bainitic ferrite and martensite; and

10% or less (may be 0%) in total of ferrite and pearlite in the proportion of area to the entire structure, wherein the mean axis ratio (major axis/minor axis) of the residual austenite grains is 5 or higher and the steel has tensile strength of 1860 MPa or higher. This steel shall be hereinafter referred to as the inventive steel 1.

The high strength spring steel of the present invention consists of 0.20 to 0.60% of C, 1.0 to 3.0% of Si, 1.0 to 3.5% of Mn, higher than 0% and not higher than 0.5% of Al, 0.15% or less P, 0.02% or less S, and iron and inevitable impurities for the rest, and is characterized in that the structure consists of:

1% or more residual austenite;

80% or more in total of bainitic ferrite and martensite; and

10% or less (may be 0%) in total of ferrite and pearlite in the proportion of area to the entire structure, wherein the mean axis ratio (major axis/minor axis) of the residual austenite grains is 5 or higher and the steel has tensile strength of 1860 MPa or higher. This steel shall be hereinafter referred to as the inventive steel 2.

The high strength spring steel of the present invention may also contain higher than 0% and not higher than 0.1% of Nb and/or higher than 0% and not higher than 1.0% of Mo, or higher than 0% and not higher than 2% of Cu and/or higher than 0% and not higher than 5% of Ni.

According to the present invention, a high strength spring steel having tensile strength of 1860 MPa or higher in which hydrogen infiltrating from the outside is neutralized and hydrogen embrittlement resistance is improved can be manufactured with high productivity without using expensive elements. It is also made possible to provide a spring that hardly experiences delayed fracture or such failures and is used as an automobile component at a low price. The high strength spring steel of the present invention contains less alloy elements than in the prior art, and can be therefore readily recycled.

DESCRIPTION OF THE PREFERRED EMBODIMENTS

Hydrogen-induced delayed fracture is believed to occur, in tempered martensite steel and steel based on martensite and ferrite that have been commonly used as high strength steels, as hydrogen is concentrated in grain boundaries of prior austenite thereby to form voids or other defects that become the start points of the fracture. Common practice that has been employed to decrease the sensitivity of delayed fracture is to diffuse fine carbide grains or the like uniformly as the trap site for hydrogen, thereby to decrease the concentration of diffusive hydrogen, as described previously as the prior art technology. However, even when a large number of carbide grains or the like are diffused uniformly as the trap site for hydrogen, there is a limitation to the hydrogen trapping capability and delayed fracture attributable to hydrogen cannot be fully suppressed.

Accordingly, the inventors of the present application studied the means of achieving higher hydrogen embrittlement resistance (delayed fracture resistance) while fully taking into account the environment where the spring steel is used.

The inventors reached such a conclusion that the best way of improving the hydrogen embrittlement resistance by decreasing the number of intergranular fracture initiating points is to form the matrix phase of the spring steel from a binary structure of bainitic ferrite and martensite with the bainitic ferrite acting as the main phase, not the single phase structure of martensite that is generally used for high strength steels. In the single phase structure of martensite, a carbide (for example, film-like cementite) is likely to precipitate in the grain boundaries, thus making intergranular fracture likely to occur. In the case of the binary structure of bainitic ferrite and martensite with the bainitic ferrite acting as the main phase, in contrast, the bainitic ferrite takes the form of plate-like ferrite that has higher dislocation density, unlike the ordinary (polygonal) ferrite, and allows it to easily increase the strength of the entire structure as in the case of the single phase of martensite while improving the hydrogen embrittlement resistance as much hydrogen is trapped in the dislocations. It also has such an advantage that coexistence of the bainitic ferrite and residual austenite which will be described later prevents the generation of carbide that acts as the intergranular fracture initiating points.

It was also found that it is very effective to form lath-shaped residual austenite for increasing the hydrogen trapping capacity and neutralizing hydrogen, thereby to improve hydrogen embrittlement resistance. It has been believed in the past that residual austenite has an adverse effect on hydrogen embrittlement resistance and fatigue characteristic. However, according to the research conducted by the present inventors, it was found that the residual austenite has a form of blocks on the order of micrometers which adversely affects the hydrogen embrittlement resistance and fatigue characteristic, though controlling the form of residual austenite in lath shape of size on the order of sub-micrometers makes it possible to put the hydrogen storing capability of the residual austenite into full play so as to store and trap much hydrogen thereby to achieve significant improvement of hydrogen embrittlement resistance.

The reason for specifying the structures of the steel of the present invention will now be described in detail below.

<Bainitic Ferrite (BF) and Martensite (M): 80% or More>

The steel of the present invention is made in binary phase structure of bainitic ferrite and martensite (bainitic ferrite is the main phase). As described previously, bainitic ferrite is a hard structure and enables it to achieve high strength of the steel. Also because the matrix phase has high density of dislocations so that much hydrogen can be trapped in the dislocations, higher hydrogen storing capability than other types of TRIP steel is obtained. Moreover there is such an advantage that the lath-shaped residual austenite specified in the present invention is readily generated in the boundary between the lath-shaped bainitic ferrite grains, thereby giving the steel excellent drawability. In order to achieve these effects efficiently, total area of bainitic ferrite and martensite is set to 80% or more, preferably 85% or more and more preferably 90% or more in proportion to the entire structure. Upper limit of the proportion may be determined by the balance with other structure (residual austenite), and is set to 99% when other structure (ferrite, etc.) than the residual austenite is not contained.

The bainitic ferrite is a lower structure having high density of dislocations consisting of plate-shaped ferrite. It is clearly distinguished from polygonal ferrite that has a lower structure containing no or very low density of dislocations, by SEM observation as follows.

Area proportion of bainitic ferrite structure is determined as follows. A test piece (rod shape) is cut off so that a position one half of the diameter in the cross section can be observed, and the surface is etched with Nital etchant. A measurement area (about 50 by 50 μm) at an arbitrarily chosen position in the surface is observed with a magnification factor of 1500 by means of a scanning electron microscope (SEM).

Bainitic ferrite is shown with dark gray color in SEM photograph (bainitic ferrite, residual austenite and martensite may not be distinguishable in the case of SEM observation), while polygonal ferrite is shown black in SEM photograph and has polygonal shape that does not contain residual austenite and martensite inside thereof.

The SEM used in the present invention is a high-resolution FE-SEM (Field Emission type Scanning Electron Microscope XL30S-FEG manufactured by Philips Inc.) equipped with an EBSP (Electron Back Scattering Pattern) detector, that has a merit of being capable of analyzing the area observed by the SEM at the same time with the EBSP detector. EBSP detection is carried out as follows. When the sample surface is irradiated with electron beam, the EBSP detector analyzes the Kikuchi pattern obtained from the reflected electrons, thereby to determine the crystal orientation at the point where the electron beam has hit upon. Distribution of orientations over the sample surface can be measured by scanning the electron beam two-dimensionally over the sample surface while measuring the crystal orientation at predetermined intervals. The EBSP detection method has such an advantage that different structures that are regarded as the same structure in the ordinary microscopic observation but have different crystal orientations can be distinguished by the color tone.

<Residual Austenite (Residual $\gamma$, $\gamma_R$): 1% or More>

Residual austenite, that contributes not only to the improvement of total elongation as has been known in the prior art but also to the improvement of hydrogen embrittlement resistance, is contained in a proportion of 1% or more in the steel of the present invention. The proportion is preferably 2% or more, and more preferably 3% or more. Excessive content of the residual austenite makes it unable to achieve a desired strength, and therefore it is recommended to set an upper limit of 20% to the proportion. The upper limit is more preferably 15%.

The inventors found that, when the residual austenite has lath shape, hydrogen trapping capability far exceeding that of carbide is obtained and, in case the shape has mean axis ratio (major axis/minor axis) of 5 or higher, hydrogen that infiltrates through the so-called atmospheric corrosion can be substantially neutralized thereby greatly improving the hydrogen embrittlement resistance, as described previously. Mean axis ratio of the residual austenite is preferably 10 or higher, more preferably 15 or higher.

In view of stability of the residual austenite, it is recommended to control the C concentration ($C_{\gamma R}$) in the residual austenite to 0.8% or higher. When the value of $C_{\gamma R}$ is controlled to 0.8% or higher, it is also made possible to improve the elongation characteristic and other properties effectively. $C_{\gamma R}$ is preferably 1.0 or higher and more preferably 1.2% or higher. While it is preferable that $C_{\gamma R}$ is as high as possible, it is considered that in practice there is an upper limit of around 1.6%.

The residual austenite refers to a region that is observed as FCC (face centered cubic lattice) by the FE-SEM/EBSP method. Measurement by the EBSP may be done, for example, by measuring a measurement area (about 50 by 50 μm) at an arbitrarily chosen position in the cross section of a test piece (rod shape) at a position of one half of the diameter at measuring intervals of 0.1 μm, as in the case of the observation of the bainitic ferrite and martensite. The measuring surface is prepared by electrolytic polishing in order to prevent the residual austenite from transforming. Then the test piece is set in the lens barrel of the FE-SEM equipped with the EBSP detector and is irradiated with electron beam. An EBSP image projected onto a screen is captured by a high sensitivity camera (VE-1000-SIT manufactured by Dage-MTI Inc.) and is sent to a computer. The computer carries out image analysis and generates color mapping of the FCC phase through comparison with a structural pattern simulated with a known crystal system (FCC (face centered cubic lattice) phase in the case of residual austenite). Area proportion of the region that is mapped as described above is taken as the area proportion of the residual austenite. This analysis was carried out by means of hardware and software of OIM (Orientation Imaging Microscopy™) system of TexSEM Laboratories Inc.

The mean axis ratio was determined by measuring the major axis and minor axis of residual austenite crystal grain existing in each of three arbitrarily chosen fields of view in the observation by means of TEM (transmission electron microscope) with magnification factor of 15000, and averaging the ratios of major axis to minor axis.

<Ferrite (F)+Pearlite (P): 10% or Less (May be 0%)>

The spring steel of the present invention may be constituted from only the structure described above (mixed structure of bainitic ferrite+martensite and residual austenite). However, other structures of ferrite (which refers to polygonal ferrite, namely ferrite that contains no or very low density of dislocations) and/or pearlite to such an extent that does not compromise the effects of the present invention. While these structures may inevitably remain in the steel through the manufacturing process of the present invention, their content is preferably as small as possible and is controlled to not higher than 10%, preferably below 5% and more preferably below 3%, according to the present invention.

The present invention is characterized in that the metallurgical structure is controlled as described above. In order to form such a structure and improve the hydrogen embrittlement resistance and increase the strength, it is necessary to control the composition of the steel as follows.

<C: from 0.20 to 0.60%>

C is an essential element required to ensure high strength of 1860 MPa or higher and retain the residual austenite. Particularly it is important to contain a sufficient content of C in the austenite phase, so as to maintain the desired austenite phase to remain at the room temperature. In order to make use of this action, it is necessary to contain 0.20% or more C content, preferably 0.25% or more. Since excessive C content decreases the toughness and therefore leads to lower hydrogen embrittlement resistance, C content is controlled within 0.60%, preferably 0.5% or lower.

<Si: 1.0 to 3.0%>

Si is an important element that effectively suppresses the residual austenite from decomposing and carbide from being generated, and is also a substitution type solid solution strengthening element that is effective for hardening the material. In order to make full use of these effects, it is necessary to contain Si in a concentration of 1.0% or higher, preferably 1.2% or higher and more preferably 1.5% or higher. However, excessively large content of Si decreases the toughness and leads to lower hydrogen embrittlement resistance, Si content is controlled within 3.0%, preferably within 2.7% and more preferably within 2.5%.

<Mn: 1.0 to 3.5%>

Mn is an element required to stabilize austenite phase and obtain the desired level of residual austenite. In order to make full use of this effect, it is necessary to contain Mn in a concentration of 1.0% or higher, and preferably 1.2% or higher and more preferably 1.5% or higher. However, since excessive content of Mn leads to conspicuous segregation and results in poor machinability, Mn content is controlled within 3.5%, preferably within 3.2% and more preferably within 3.0%.

<Al: 1.5% or Less (Higher than 0%)>(In the Case of Inventive Steel 1)<

Al: 0.5% or Less (Higher than 0%)>(In the Case of Inventive Steel 2)

0.01% or higher content of Al may be contained for the purpose of deoxidation. In addition to deoxidation, Al also has the effects of improving the corrosion resistance and improving hydrogen embrittlement resistance.

The mechanism of improving the corrosion resistance is supposedly based on the improvement of corrosion resistance of the matrix per se and the effect of formation rust generated by atmospheric corrosion, while the effect of formation rust presumably has greater contribution. This is supposedly because the formation rust is denser and better in protective capability than ordinary iron rust, and therefore checks the progress of atmospheric corrosion so as to decrease the amount of hydrogen generated by the atmospheric corrosion, thereby to effectively suppress the occurrence of hydrogen embrittlement, and hence the delayed fracture.

While details of the mechanism of improvement of the hydrogen embrittlement resistance by Al is not known, it is supposed that condensing of Al on the surface of the steel makes it difficult for hydrogen to infiltrate into the steel, and the decreasing diffusion rate of hydrogen in the steel makes it difficult for hydrogen to migrate so that hydrogen embrittlement becomes less likely to occur. In addition, stability of lath-shaped residual austenite improved by the addition of Al is believed to contribute to the improvement of hydrogen embrittlement resistance.

In order to effectively achieve the effects of Al in improving the corrosion resistance and improving the hydrogen embrittlement resistance, Al content is controlled to 0.02% or higher, preferably 0.2% or higher and more preferably 0.5% or higher.

However, Al content must be controlled within 1.5% in order to keep inclusions such as alumina from increasing in number and size so as to ensure satisfactory machinability, ensure the generation of fine residual austenite, suppress corrosion from proceeding with the inclusion containing Al as the starting point, and prevent the manufacturing cost from increasing. In view of the manufacturing process, it is preferable to control so that $A_3$ point is not higher than 1000° C.

As the Al content increases, inclusions such as alumina increase and delayed fracture resistance becomes poorer. In order to suppress the generation of the inclusions such as alumina and make a steel having higher delayed fracture resistance, Al content is restricted within 0.5%, preferably within 0.3% and more preferably within 0.1%.

<P: 0.15% or Lower)

P is an element that promotes intergranular fracture due to intergranular segregation. Therefore, P content is preferably as low as possible with an upper limit set to 0.15%. P content is controlled to preferably within 0.1%, and more preferably within 0.05%.

<S: 0.02% or Lower>

S is an element that promotes absorption of hydrogen in the spring steel in corrosive environment. S content is controlled to within 0.02%, and preferably within 0.01%.

While composition of the steel of the present invention is as described above with the rest substantially consisting of Fe, it may contain inevitable impurities introduced into the steel depending on the stock material, production material, manufacturing facility and other circumstances, containing 0.01% or less nitrogen. In addition, other elements as described below may be intentionally added to such an extent that does not adversely affect the effects of the present invention.

<Nb: 0.1% or Lower (Higher than 0%) and/or Mo: 1.0% or Lower (Higher than 0%)

Nb has great effect in increasing the strength of the spring steel and decreasing the grain size, and the effects can be enhanced by adding Nb and Mo together. It is recommended to add 0.005% or more (preferably 0.01% or more) Nb in order to achieve the effects described above. However, the effects described above reach saturation when excessive Nb content is contained, resulting in economical disadvantage. Therefore, Nb content is limited to 0.1% or less.

Mo has the effects of stabilizing austenite so as to retain residual austenite, impeding the infiltration of hydrogen so as to improve hydrogen embrittlement resistance and improving the hardenability of the spring steel. It also has the effect of strengthening the grain boundary so as to suppress hydrogen embrittlement from occurring. It is recommended to add 0.005% or more (preferably 0.01% or more) Mo in order to achieve these effects. However, since the effects described above reach saturation when excessive Mo content is contained, resulting in economical disadvantage, Mo content is limited to 1.0% or less.

<Cu: 2% or Lower (Higher than 0%) and/or Ni: 5% or Lower (Higher than 0%)

Addition of Cu and/or Ni enables it to effectively suppress the generation of hydrogen that causes hydrogen embrittlement, and at the same time suppress hydrogen that has been generated from infiltrating into the spring steel. As a result, diffusive hydrogen concentration in the spring steel can be decreased to a harmless level by the synergy effect of the effects of these elements and the effects of the composition described above to improve the hydrogen trapping capability of the spring steel.

Specifically, Cu and Ni have the effect of improving the corrosion resistance of the steel itself thereby to suppress the generation of hydrogen through corrosion of the spring steel. These elements also have the effect of promoting the generation of iron oxide, α-FeOOH, that is believed to be particularly stable thermodynamically and have protective property among various forms of rust generated in the atmosphere. By assisting the generation of this rust, it is made possible to suppress hydrogen that has been generated from infiltrating into the spring steel thereby to sufficiently improve the hydrogen embrittlement resistance to endure in harsh corrosive environment. This effect can be achieved particularly satisfactorily when Cu and Ni are contained at the same time.

In order to achieve the effects described above, concentration of Cu, if added, is preferably 0.03% or higher and more preferably 0.1% or higher, and concentration of Ni, if added, is preferably 0.03% or higher and more preferably 0.1% or higher.

Since excessively high concentration of either Cu or Ni is detrimental to machinability, it is preferable to limit the Cu content to 2% or lower (more preferably 1.5% or lower) and limit the Ni content to 5% or lower (more preferably 3% or lower).

<Cr: 2% or Lower (Higher than 0%)>

Cr is a useful element that improves hardenability without hardly affecting the deformability, thereby to easily achieve high strength. In order to fully achieve this effect, it is preferable that 0.1% or more Cr is contained. However, excessively high concentration of Cr leads to the generation of cementite that makes it difficult for residual austenite to remain, and therefore concentration of Cr is preferably controlled within 2%.

<Ti and/or V: 0.003 to 1.0% in Total>

Ti has the effect of assisting in the generation of protective rust, similarly to Cu and Ni. The protective rust has a very valuable effect of suppressing the generation of β-FeOOH that appears in chloride environment and has adverse effect on the corrosion resistance (and hence on the hydrogen embrittlement resistance). Formation of such a protective rust is promoted particularly by adding Ti and V (or Zr). Ti renders the steel excellent corrosion resistance, and also has the effect of cleaning the steel.

V is effective in increasing the strength of the spring steel and decreasing the crystal grains, in addition to having the effect of improving hydrogen embrittlement resistance through cooperation with Ti, as described previously.

In order to fully achieve the effect of Ti and/or V described above, it is preferable to add Ti and/or V to total concentration of 0.003% or higher (more preferably 0.01% or higher). For the purpose of improving hydrogen embrittlement resistance, in particular, it is preferable to add more than 0.03% of Ti, more preferably 0.05% or more Ti. However, the effects described above reach saturation when an excessive amount of Ti is added, resulting in economical disadvantage. Excessive V content also increases the precipitation of much carbonitride and leads to poor machinability and lower hydrogen embrittlement resistance. Therefore, it is preferable to control the total concentration of Ti and/or V to within 1.0%, more preferably within 0.8%.

<Zr: 0.003 to 1.0%>

Zr is effective in increasing the strength of the spring steel and decreasing the crystal grain size, and also has the effect of improving hydrogen embrittlement resistance through cooperation with Ti. In order to sufficiently achieve these effects, it is preferable that 0.003% or more Zr is contained. However, excessive Zr content increases the precipitation of carbonitride and leads to poor machinability and lower hydrogen embrittlement resistance. Therefore, it is preferable to control the concentration of Zr to within 1.0%.

<B: 0.0002 to 0.01%>

B is effective in increasing the strength of the spring steel, and it is preferable that 0.0002% or more (more preferably 0.0005% or more) B is contained. However, excessive content of B leads to poor hot machinability. Therefore, it is preferable to control the concentration of B to within 0.01% (more preferably within 0.005%).

While the present invention does not specify the manufacturing conditions, it is recommended to apply heat treatment in the following procedure after drawing the wire, in order to form the structure described above that achieves improvements in hydrogen embrittlement resistance and in strength at the same time.

The recommended procedure is to keep the drawn wire at a heating temperature (T1) in a range from $A_3$ point to ($A_3$ point +100° C.) for a period of 10 to 1800 seconds (t1), cool down the wire at a mean cooling rate of 3° C./s or higher to a temperature (T2) in a range from ($M_s$ point −50° C.) to $B_S$ point and keep the material at this temperature for a period of 60 to 3600 seconds (t2).

It is not desirable that the temperature T1 becomes higher than ($A_3$ point +100° C.) or the period t1 is longer than 1800 seconds, in which case austenite grains grow and the structure becomes coarse. When the temperature T1 is lower than $A_3$, on the other hand, desirable bainitic ferrite structure cannot be obtained. When the period t1 is shorter than 10 seconds, austenitization does not proceed sufficiently and therefore cementite and other alloy carbides remain. The temperature T1 is preferably not lower than $A_3$ point and not higher than ($A_3$ point +50° C.). The period t1 is preferably in a range from 30 to 1500 seconds, more preferably from 60 to 1200 seconds.

Then the material is cooled down. According to the present invention, it is recommended to cool down the wire at a mean cooling rate of 3° C./s or higher to a temperature in a range from ($M_s$ point −50° C.) to Bs point and keep the material at this temperature for a period of 60 to 3600 seconds.

The reason for cooling down the material at the mean cooling rate of 3° C./s or higher is to form the desired bainitic ferrite structure and avoid the formation of pealite structure that is undesirable for the present invention. The mean cooling rate is preferably as high as possible, and it is recommended to set it to 10° C./s or higher (more preferably 20° C./s or higher).

Then the material is quenched to a temperature between ($M_s$ point −50° C.) and Bs point, followed by isothermal transformation, thereby to form the desired structure. When the heat retaining temperature becomes higher than Bs point, pealite structure that is undesirable for the present invention is formed, thus making it impossible to obtain the desired bainitic ferrite structure. When the heat retaining temperature is lower than ($M_s$ point −50° C.), area proportion of residual austenite becomes smaller.

When the heat retaining period is longer than 3600 seconds, residual austenite decomposes and cementite is formed, leading to failure to achieve the desired performance. When the heat retaining period is shorter than 60 seconds, sufficient diffusion of C does not occur and residual austenite cannot be formed, in which case again leading to failure to achieve the desired performance. The heat retaining period is preferably in a range from 100 to 3000 seconds, more preferably from 180 to 2400 seconds.

The wire materials made by hot rolling are drawn and subjected to the above-mentioned heat treatment (austempering) to obtain the spring steel of the present invention.

Softening annealing, peeling, lead patenting or the like may be applied before the wire drawing operation. After forming the spring, the spring may be subjected to stress relieving annealing, double shot peening, low-temperature annealing, cold setting or the like as in common practice.

The spring steel obtained by the present invention has high strength and excellent hydrogen embrittlement resistance, as well as fatigue characteristic that has been required in the prior art, and is therefore useful in the manufacture of springs that are used in such fields of automobile and industrial machinery. The spring steel of the present invention is particularly suitable for springs and other members used in restoring mechanism of various machines such as valve spring of automobile engine, suspension spring, clutch spring and brake spring.

The present invention will now be described below by way of examples, but the present invention is not limited to the example. Various modifications may be conceived without departing from the spirit of the present invention.

EXAMPLE

Steel materials A through P having the compositions described in Table 1 were melt-refined and formed into 115 mm square billets by forging. The billets were rolled to decrease the diameter to 12.5 mm, followed by wire drawing operation to decrease the diameter to 12 mm. The drawn wire was cut to length of 300 mm and was subjected to heat treatment (refining). The heat treatment was carried out in such a procedure as, after keeping the test piece at a temperature of ($A_3$ point +30° C.) for 5 minutes, the test piece was cooled down to To shown in Table 2 at a cooling rate of 10° C./s and was kept at this temperature (To) for t seconds as shown in Table 2, following by spontaneous cooling thereby to obtain the spring steel.

The spring steels obtained as described above were investigated for the metal structure, tensile strength (TS), elongation (total elongation E1), hydrogen embrittlement resistance and fatigue characteristic in the following procedure.

Observation of Metal Structure

The test pieces prepared as described above were observed and photographed in a measurement area (about 50 by 50 μm at measuring intervals of 0.1 μm) at an arbitrarily chosen position in the cross section of the test piece at a position of one half of the diameter, and area proportion of bainitic ferrite (BF) and martensite (M) and area proportion of residual austenite (residual γ) were measured by the method described previously. Similar measurements were made in two fields of view that were arbitrarily selected, and the measured values were averaged. Proportions of other structures were determined by subtracting the area proportions of these structures. Mean axis ratio of the residual austenite crystal grains was determined by the method described previously.

Measurement of Tensile Strength

The various types of spring steels were machined to make tensile strength test pieces measuring 8 mm in diameter. These test pieces were subjected to tensile strength test to measure the tensile strength (TS).

Evaluation of Hydrogen Embrittlement Resistance

The various types of spring steels were machined to make delayed fracture test pieces with annular notch (measuring 8 mm in diameter in parallel portion and 6 mm in diameter in notched portion). The tensile test was conducted by applying tensile load in 5% salt water. Test pieces that showed tensile strength ratio of 0.4 or higher in the TS test were rated as excellent in hydrogen embrittlement resistance.

Some kinds of steel were subjected to hydrogen charge four-point bending test. In this test, rectangular test pieces measuring 65 mm by 8 mm made of the various types of spring steels described above were immersed in (0.5 mol/$H_2SO_4$+0.01 mol/KSCN) solution and were cathodically charged with hydrogen, so as to measure the maximum stress that was endured for 1 hour without rupture as the critical fracture load (DFL). Ratio of this value to the value of DFL of experiment No. 1 (steel A) shown in Table 2 was determined.

Evaluation of Fatigue Characteristic

In order to evaluate the fatigue characteristic that a spring is required to have, fatigue test was conducted as follows. The spring steel was rolled to decrease the diameter to 8.0 mm, followed by wire drawing operation to decrease the diameter to 4.6 mm so as to make oil tempered (OT) wire that was subjected to Nakamura's rotation bending fatigue test. Fatigue limit measured in this test was divided by the tensile strength to determine the fatigue limit ratio. Samples that showed fatigue limit ratio of 0.30 or higher were evaluated to have good fatigue characteristic. The fatigue test was conducted on samples that had tensile strength of 1860 MPa or higher, because steel of lower tensile strength generally has satisfactory fatigue characteristic.

The test results are shown in Table 2.

TABLE 1

| Type of | Formulation of chemical components* (mass %) | | | | | | | | | | | Ac3 | Bs | Ms |
|---|---|---|---|---|---|---|---|---|---|---|---|---|---|---|
| steel | C | Si | Mn | P | S | Al | Nb | Mo | Cu | Ni | Others | (° C.) | (° C.) | (° C.) |
| A | 0.41 | 2.03 | 2.97 | 0.03 | 0.003 | 0.033 | — | — | — | — | — | 815.9 | 452 | 269 |
| B | 0.38 | 2.01 | 2.52 | 0.03 | 0.003 | 0.031 | 0.05 | — | — | — | — | 832.5 | 500.6 | 297.7 |
| C | 0.40 | 1.98 | 2.30 | 0.03 | 0.002 | 0.033 | — | 0.3 | — | — | — | 844.8 | 490.1 | 289.2 |
| D | 0.40 | 2.00 | 2.03 | 0.02 | 0.003 | 0.032 | — | — | 0.3 | 0.3 | | 826.4 | 528 | 299 |
| E | 0.35 | 1.48 | 2.49 | 0.02 | 0.002 | 0.032 | — | — | | | Ti: 0.05 | 828.2 | 511 | 313 |
| F | 0.29 | 1.98 | 1.99 | 0.03 | 0.003 | 0.033 | — | — | — | — | Ti: 0.08, B: 0.003 | 895.7 | 573 | 358 |
| G | 0.51 | 2.01 | 2.47 | 0.02 | 0.003 | 0.032 | — | — | — | — | Cr: 0.05 | 807.6 | 470 | 237 |
| H | 0.15 | 2.52 | 3.02 | 0.02 | 0.003 | 0.031 | 0.05 | 0.5 | — | — | — | 895.6 | 476 | 380 |
| I | 0.41 | 0.49 | 2.48 | 0.02 | 0.002 | 0.033 | — | 0.5 | — | — | — | 770.5 | 455 | 274 |
| J | 0.70 | 2.01 | 2.01 | 0.033 | 0.013 | 0.003 | — | — | — | — | — | 794.0 | 460.1 | 162.9 |
| K | 0.40 | 2.01 | 2.52 | 0.03 | 0.003 | 0.052 | — | — | — | — | — | 837.7 | 495.2 | 288.2 |
| L | 0.40 | 1.98 | 2.49 | 0.03 | 0.002 | 0.341 | 0.05 | — | — | — | — | 952.8 | 497.9 | 289.2 |
| M | 0.42 | 2.00 | 2.50 | 0.03 | 0.002 | 0.422 | — | 0.3 | — | — | — | 992.1 | 466.7 | 273.1 |
| N | 0.39 | 1.99 | 2.51 | 0.03 | 0.002 | 0.531 | 0.05 | 0.2 | — | — | — | 1036.6 | 482.2 | 289.1 |
| O | 0.42 | 2.00 | 2.55 | 0.03 | 0.002 | 0.71 | 0.05 | 0.2 | — | — | — | 1102.6 | 470.5 | 273.6 |
| P | 0.40 | 2.01 | 2.60 | 0.03 | 0.002 | 1.59 | 0.05 | 0.2 | — | — | — | 1456.8 | 471.4 | 281.4 |

*iron and inevitable impurities for the rest

TABLE 2

| Test No. | Type of steel | To (° C.) | t Sec | Residual γ Area % | Mean axis ratio of residual austenite crystal grains — | BF + M | F | TS MPa | Strength ratio of delayed fracture — | Fatigue limit ratio — | DFL ratio |
|---|---|---|---|---|---|---|---|---|---|---|---|
| 1 | A | 260 | 1200 | 9 | ○ | 91 | 0 | 1920 | 0.45 | 0.31 | 1.00 |
| 2 | B | 260 | 1200 | 10 | ○ | 90 | 0 | 1930 | 0.49 | 0.30 | — |
| 3 | C | 260 | 1200 | 11 | ○ | 89 | 0 | 1960 | 0.46 | 0.33 | — |
| 4 | D | 280 | 1800 | 10 | ○ | 90 | 0 | 1930 | 0.47 | 0.35 | — |
| 5 | E | 300 | 1200 | 7 | ○ | 93 | 0 | 1990 | 0.48 | 0.33 | — |
| 6 | F | 320 | 600 | 6 | ○ | 94 | 0 | 1890 | 0.50 | 0.33 | — |
| 7 | G | 280 | 2400 | 12 | ○ | 88 | 0 | 2020 | 0.44 | 0.32 | — |
| 8 | H | 300 | 1800 | 2 | ○ | 96 | 2 | 1570 | 0.51 | — | — |
| 9 | I | 300 | 1200 | 1 | x | 99 | 0 | 1440 | 0.35 | — | — |
| 10 | J | 300 | 1200 | 14 | ○ | 86 | 0 | 2100 | 0.31 | 0.21 | — |
| 11 | A | 480 | 1200 | 0* | x | 0* | 35* | 1210 | 0.72 | — | — |
| 12 | A | 200 | 1200 | 1 | x | 99 | 0 | 1910 | 0.27 | 0.25 | — |
| 13 | A | 350 | 7200 | 1 | x | 99 | 0 | 1380 | 0.33 | — | — |
| 14 | A | 320 | 10 | 1 | x | 99 | 0 | 1820 | 0.29 | 0.27 | — |
| 15 | K | 280 | 1200 | 9 | ○ | 91 | 0 | 1924 | 0.45 | 0.31 | 1.24 |
| 16 | L | 280 | 1200 | 9 | ○ | 91 | 0 | 1930 | 0.46 | 0.32 | 1.56 |
| 17 | M | 280 | 1200 | 10 | ○ | 90 | 0 | 1939 | 0.47 | 0.32 | 1.66 |
| 18 | N | 280 | 1200 | 10 | ○ | 90 | 0 | 1945 | 0.48 | 0.33 | 1.71 |
| 19 | 0 | 280 | 1200 | 11 | ○ | 89 | 0 | 1950 | 0.49 | 0.32 | 1.78 |
| 20 | P | 280 | 1200 | 13 | x | 65 | 22 | 1329 | 0.29 | — | 0.73 |

*Pearlite for the rest

The test results shown in Tables 1 and 2 can be interpreted as follows (numbers in the following description refer to the experiment Nos. given in Table 2).

Nos. 1 through 7 and 15 through 19 that satisfy the requirements of the present invention show high strength of 1860 MPa or higher and high hydrogen embrittlement resistance to endure harsh corrosive environment. Nos. 15 through 19 show particularly excellent hydrogen embrittlement resistance.

Nos. 8 through 14 and 20 that do not satisfy the requirements of the present invention have the following drawbacks.

No. 8 does not have the strength specified in the present invention due to insufficient C content. No. 9 does not have the strength specified in the present invention due to insufficient Si content.

No. 10, that was made from steel J having excessive C content, showed poor hydrogen embrittlement resistance and poor fatigue characteristic due to precipitation of carbide.

Nos. 11 through 14 were made of steels having the composition specified in the present invention, but did not develop the desired structure because they were not manufactured under the recommended conditions.

No. 11 failed to show a high strength, because it was subjected to austempering treatment at an excessively high temperature, and therefore bainitic ferrite, martensite and residual austenite could not be retained.

No. 12 was subjected to austempering treatment at a very low temperature, No. 13 was subjected to austempering treatment for an excessively long period of time and No. 14 was subjected to austempering treatment for too short a period of time, and therefore all of these samples developed polygonal form of residual γ, resulting in poor hydrogen embrittlement resistance.

No. 20 contained Al content higher than that specified for the inventive steel 1, and therefore retained the predetermined amount of residual austenite, but the residual austenite did not satisfy the requirement for the mean axis ratio specified in the present invention, did not form the desired matrix phase while inclusions such as AlN were formed, thus resulting in poor hydrogen embrittlement resistance.

What is claimed is:

1. A high strength steel spring having excellent hydrogen embrittlement resistance, which spring is made from a steel which comprises:

0.20 to 0.60% of C, 1.0 to 3.0% of Si, 1.0 to 3.5% of Mn, higher than 0% and not higher than 1.5% of Al, 0.15% or less of P, 0.02% or less of S, and balance of iron and inevitable impurities, wherein the structure includes:

1% or more residual austenite;

80% or more in total of bainitic ferrite and martensite; and

10% or less (may be 0%) in total content of ferrite and pearlite in the proportion of area to the entire structure, and wherein the mean axis ratio (major axis/minor axis) of the residual austenite grains is 5 or higher and the steel tensile strength is 1860 MPa or higher, and wherein the spring is made by a wire drawing operation.

2. A high strength steel spring having excellent hydrogen embrittlement resistance according to the claim 1, which steel further comprises:

higher than 0% and not higher than 0.1% of Nb and/or higher than 0% and not higher than 1.0% of Mo.

3. A high strength steel spring having excellent hydrogen embrittlement resistance according to the claim 1, which steel further comprises:

higher than 0% and not higher than 2% of Cu and/or higher than 0% and not higher than 5% of Ni.

4. A high strength steel spring having excellent hydrogen embrittlement resistance according to the claim 2, which steel further comprises:

higher than 0% and not higher than 2% of Cu and/or higher than 0% and not higher than 5% of Ni.

5. A high strength steel spring having excellent hydrogen embrittlement resistance according to the claim 1, which further comprises:

higher than 0% and not higher than 2% of Cr.

6. A high strength steel spring having excellent hydrogen embrittlement resistance according to the claim 1, which further comprises:

0.003 to 1% of Ti and/or V.

7. A high strength steel spring having excellent hydrogen embrittlement resistance according to the claim 1, which further comprises:

0.003 to 1% of Zr.

8. A high strength steel spring having excellent hydrogen embrittlement resistance according to the claim 1, which further comprises:

0.0002 to 0.0 1% of B.

* * * * *

UNITED STATES PATENT AND TRADEMARK OFFICE

CERTIFICATE OF CORRECTION

PATENT NO. : 7,438,770 B2
APPLICATION NO. : 11/340547
DATED : October 21, 2008
INVENTOR(S) : Yuse et al.

It is certified that error appears in the above-identified patent and that said Letters Patent is hereby corrected as shown below:

On the title page, Item (73), the Assignee information is incorrect. Item (73) should read:

Item -- (73) Assignee: Kabushiki Kaisha Kobe Seiko Sho (Kobe Steel, Ltd.), Kobe-shi (JP); Shinshu TLO Co., Ltd., Ueda-shi (JP) --

Signed and Sealed this

Thirtieth Day of December, 2008

JON W. DUDAS
*Director of the United States Patent and Trademark Office*